US006412316B1

(12) United States Patent
Buss

(10) Patent No.: US 6,412,316 B1
(45) Date of Patent: Jul. 2, 2002

(54) CASE LOCK

(75) Inventor: Wolfgang Buss, Solingen (DE)

(73) Assignee: S. Franzen Söhne (GmbH & Co.), Solingen (DE)

( * ) Notice: Subject to any disclaimer, the term of this patent is extended or adjusted under 35 U.S.C. 154(b) by 0 days.

(21) Appl. No.: 09/468,283

(22) Filed: Dec. 20, 1999

(30) Foreign Application Priority Data

Dec. 22, 1998 (DE) ..... 198 59 306

(51) Int. Cl.[7] ..... E05B 65/52
(52) U.S. Cl. ..... 70/69; 70/71; 70/312
(58) Field of Search ..... 70/67, 69–76, 70/312, 316–318, 333 R, 417

(56) References Cited

U.S. PATENT DOCUMENTS

| | | | | | |
|---|---|---|---|---|---|
| 2,907,196 | A | * | 10/1959 | Duttine | 70/70 X |
| 3,031,874 | A | * | 5/1962 | Levine | 70/70 |
| 3,206,953 | A | * | 9/1965 | Atkinson | 70/70 |
| 3,543,545 | A | * | 12/1970 | Budzyn | 70/71 |
| 3,736,778 | A | * | 6/1973 | Bako | 70/70 |
| 4,279,136 | A | * | 7/1981 | Miles | 70/71 |
| 4,318,287 | A | * | 3/1982 | Remington et al. | 70/71 |
| 4,341,101 | A | * | 7/1982 | Bako | 70/312 |
| 4,343,163 | A | * | 8/1982 | Scelba et al. | 70/71 X |
| 4,356,712 | A | * | 11/1982 | Bako | 70/69 |
| 4,366,685 | A | * | 1/1983 | Remington | 70/70 |
| 4,416,126 | A | * | 11/1983 | Remington | 70/71 |
| 4,462,232 | A | * | 7/1984 | Yang | 70/312 |
| 4,487,043 | A | * | 12/1984 | Miles | 70/312 |
| 4,646,547 | A | * | 3/1987 | Scelba et al. | 70/312 |
| 4,884,419 | A | * | 12/1989 | Ling | 70/312 X |
| 5,092,149 | A | * | 3/1992 | Bartsch et al. | 70/312 |
| 5,150,590 | A | * | 9/1992 | Ling | 70/69 |
| 5,193,369 | A | * | 3/1993 | Rose et al. | 70/71 |
| 5,211,040 | A | * | 5/1993 | Gisiger | 70/71 |

FOREIGN PATENT DOCUMENTS

| | | |
|---|---|---|
| DE | 2946091 | 5/1981 |

* cited by examiner

*Primary Examiner*—Suzanne Dino Barrett
(74) *Attorney, Agent, or Firm*—Martin A. Farber

(57) ABSTRACT

A case lock having a locking slide (19) which is arranged in a lock housing (11) and is intended for securing and, by gripactuated displacement counter to spring force, for releasing a mating closure part (6). A grip (29) forms a supporting shoulder (40) which in a securing position, blocking the displacement of the locking slide (19), is located in front of a blocking shoulder (41) of the housing (11) and, by the grip (29) being pivoted transversely to displacement direction of the locking slide (19), is displaced into a release position.

10 Claims, 5 Drawing Sheets

34'
36
29
34
35
8
21
4
23
15
11
18
1
17
13
18
3
2
6
9
10
7
5
5

CASE LOCK

FIELD AND BACKGROUND OF THE INVENTION

The invention relates to a case lock having a locking slide which is arranged in the lock housing and is intended for securing and, by grip-actuated displacement counter to spring force, for releasing a mating closure part.

A case lock of the type in question is known, for example, from DE 29 46 091 C2, in which configuration a spring forces the locking slide in a linear direction. If the locking slide is not in the blocked position, then it is possible, by the action of impact on the case, for the locking slide to pass, on account of the force of inertia, out of its engagement position in relation to the mating closure part, this being associated with undesired opening of the case.

SUMMARY OF THE INVENTION

The object of the invention is to configure a case lock of the generic type such that, even with impact loading, the locking slide does not leave its locked position in relation to the mating closure part.

This object is achieved first and foremost essentially by a case lock having the introductory-mentioned, features wherein the grip forms a supporting shoulder which in the securing position, blocking the displacement of the locking slide, is located in front of a blocking shoulder of the housing and, by virtue of the grip being pivoted transversely to the displacement direction of the locking slide, is displaced into a release position.

Such a configuration gives an increased security value to a case lock of the type in question. With the case lock unlocked, impact loading acting on the closed case is not capable of disengaging the locking slide from the mating closure part. Intentional manipulation is required in order to bring about the unlocked position. First of all, the grip has to be pivoted transversely to the displacement direction of the locking slide. In this case, the grip-side supporting shoulder passes out of the region of the blocking shoulder of the housing. It is only then that the locking slide can be displaced into the release position, in which case the mating closure part is released. It is favorable in structural terms if the grip is retained in the blocking position by the locking-slide spring acting on it. Just a single spring is thus sufficient for the grip and the locking slide. The spring force of said spring thus retains the grip in the position in which the supporting shoulder is located opposite the blocking shoulder. Furthermore, the locking slide is forced in the securing direction by said spring. It has proven optimum to provide two supporting shoulders located approximately level with the spring-engagement point. The housing then also forms two blocking shoulders for said supporting shoulders. Installation-related advantages are achieved in that the articulated connection between the grip and locking slide is formed by a hook-in spindle supported on the housing base. The grip can be assigned to the locking slide by way of a plug-in connection. This is secured by the housing base which is present in any case. If the locking slide is displaced into its release position, then, in the end phase of the slide movement, an ejector is released, and this acts on the mating closure part. In this ejector position, the locking slide is retained in its release position by the displaced ejector. Specifically, this is such that, by virtue of locking-slide displacement into the release position, the ejector advances by spring action. The interaction of the ejector and locking slide is realized in a simple manner by a guide protrusion which engages in an L-shaped guide groove of the locking slide and belongs to the ejector, which can be extended transversely to the displacement direction of the locking slide. The locking slide is only blocked once the case is closed, the mating closure part displacing the ejector counter to spring force and thus moving the guide protrusion into that L-leg of the guide groove which runs in the displacement direction, with the result that the spring which loads the locking slide and grip can come into action, bringing about the engagement position between the mating closure part and locking slide in the process. A further advantage of the invention is to be seen in the fact that a plate which closes off a housing opening in the closed position and belongs to the grip moves beneath the housing wall following the pivoting during the opening displacement. Said housing wall also serves for securing the grip in its release position. Finally, a further advantageous feature is that of providing a finger-engagement web formed by the grip, the grip being pivoted by a force exerted on said finger-engagement web in the locking-slide displacement direction. As with the known case locks, the user can thus act on the grip, the latter pivoting in the transverse direction in relation to the slide, whereupon the corresponding action of force results in a displacement of the locking slide.

BRIEF DESCRIPTION OF THE DRAWINGS

An exemplary embodiment of the invention is explained hereinbelow with reference to the figures of the drawing, in which.

DETAILED DESCRIPTION OF THE PREFERRED EMBODIMENT

Figure 1:
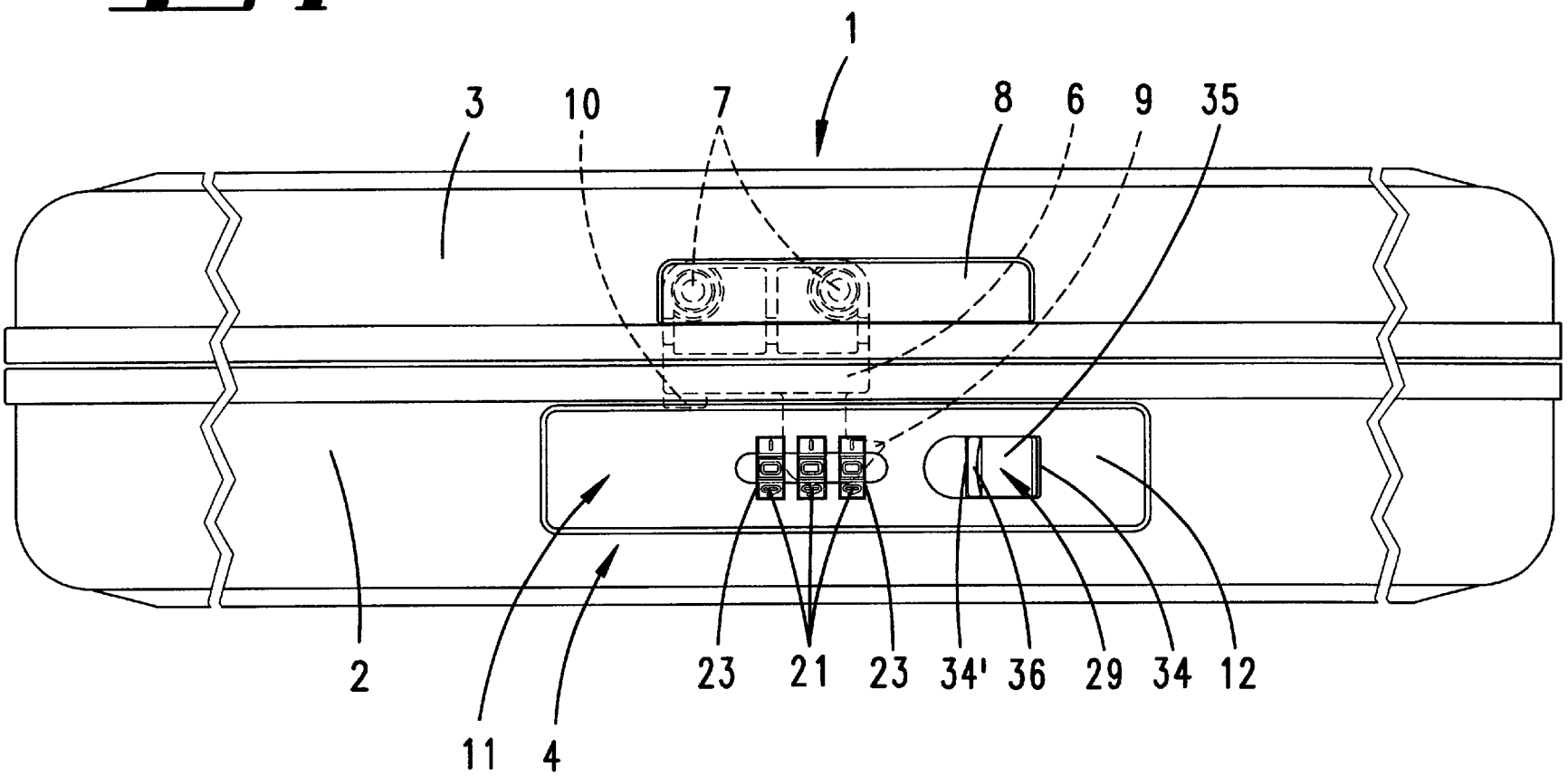
FIG. 1 shows a view of the narrow side of the case which is equipped with the case lock, with the case lid closed.
Figure 2:
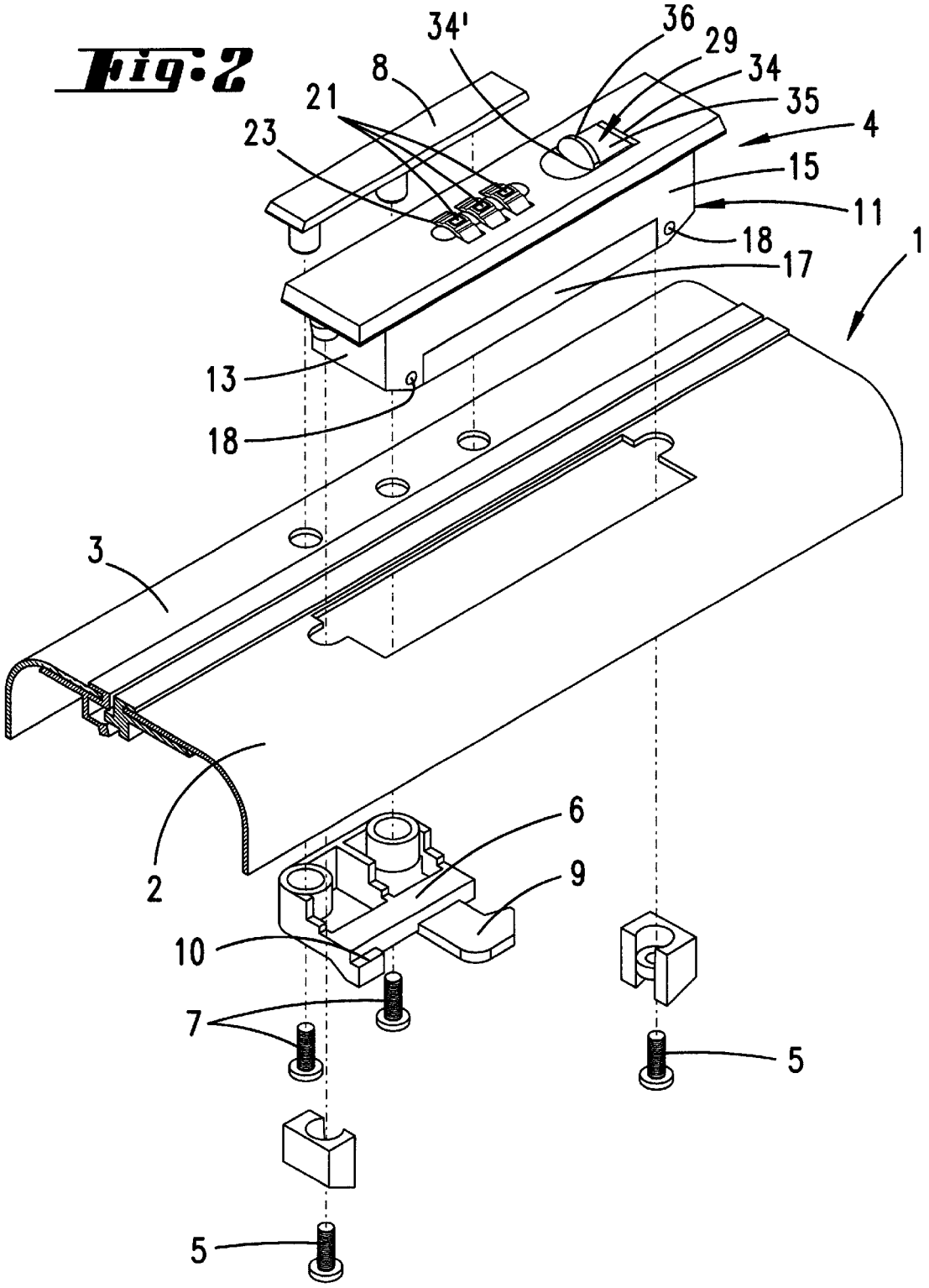
FIG. 2 shows a perspective exploded illustration of the components of the case lock before installation.

A case is designated overall by 1. Said case has a bottom part 2 and a lid part 3, which are connected to one another in an articulated manner via hinges (not illustrated). A case lock 4 is located on that narrow side of the case which is located opposite the hinges. Said case lock can be secured on the bottom part 2 by means of screws 5, see FIG. 2. Opposite said case lock, the lid part 3 bears a mating closure part 6. In order to fasten the latter, use is made of screws 7 which engage through the mating closure part 6, arranged on the inside of the case, and pass into a covering plate 8 assigned to the lid part 3. The mating closure part 6 forms a projecting hook protrusion 9 which interacts with the case lock 4. Furthermore, a supporting protrusion 10 extends from that narrow surface of the mating closure part 6 which exhibits the hook protrusion 9.

In specific terms, the case lock 4 has a housing 11 which forms a housing cover 12. Two narrow housing walls 13, 14 and two longitudinal housing walls 15, 16 extend downward from said housing cover. The opening formed by the walls 13 to 16 is closed off by a housing base 17, to be precise by means of transverse pins 18 which pass through the longitudinal case walls 15, 16.

A locking slide 19 can be displaced on the housing base 17 in the longitudinal direction of the lock. Located above said locking slide, in the housing interior, is a safety catch 20 which is configured as a permutation lock and is of a construction which is known per se. The safety catch 20 contains three adjustment disks 21 which are arranged parallel one beside the other, exhibit numbers, are arranged on a common spindle 22, which extends in the longitudinal direction of the lock, and engage through through-passages 23, with the result that the adjustment disks 21 project slightly beyond the housing cover 12. Blocking sleeves (not illustrated specifically) interact with the adjustment disks 21 in a known manner, said blocking sleeves, with a correctly adjusted secret code, allowing a pivoting displacement of a blocking rocker 24. Said blocking rocker serves for blocking the blocking slide 19. For this purpose, a stop protrusion 25 extends from that end of the locking slide 19 which is adjacent to the narrow housing wall 13. With the safety catch 20 assuming the locked position, the blocking rocker 24 extends in front of the stop protrusion 25 of the locking slide 19, with the result that the latter cannot be displaced into the release position, see FIG. 3. In this position, the hook protrusion 9 of the mating closure part 6 has engaged behind a blocking web 26 of the locking slide 19, with the result that opening of the case is thus prevented.

At that end of the locking slide 19 which is located opposite the stop protrusion 25, a clearance 27 is provided, for receiving a hook-in spindle 28 of a grip 29. The plug-in spindle 28 is secured in its position by the housing base 17. The connection between the grip 29 and hook-in spindle 28 is constituted by an angled web 30. In the locked position of the locking slide 19, the thicker web leg 31 in the slide-displacement direction runs parallel to the narrow housing wall 14. Located in said web leg 31 is a bore 32 into which there penetrates one end of a locking-slide spring 33, which is configured as a compression spring. The other end of said spring is supported on the narrow housing wall 14. When the grip 29 is not displaced, the spring 33 rises up slightly from the narrow housing wall 14. The grip 29 is thus allowed to pivot in the counter clockwise direction, this being delimited by the narrow border edge 34' of a housing opening 34, see FIG. 3. In this closed position, a top plate 35, which extends in the direction of the narrow housing wall 14 and is assigned to the grip 29, closes off the relevant housing opening 34. A finger-engagement web 36 extends upward from the plate 35 and transversely to the longitudinal direction of the housing 11.

Located at that end of the housing base 17 which is adjacent to the narrow housing wall 13 is a transverse clearance 37 which is intended for receiving an ejector 38 and has the locking slide 19 engaging over it. A compression spring 39 forces said ejector into its ejector position. For the through-passage of the ejector 38, the longitudinal housing wall 16 forms a recess (not illustrated). A clearance (not illustrated) is also provided adjacent to said recess in the longitudinal housing wall 16, which clearance receives the hook protrusion 9 of the mating closure part 6. The latter can thus pass into operative connection in relation to the stop protrusion 25 of the locking slide 19.

In order to prevent the situation where, when impact loading acts on the case, the locking slide 19, on account of the force of inertia, is disengaged from the mating closure part 6, to be precise when the safety catch 20 is not activated, the grip has level with the bore 32, that is to say the spring-engagement point, a shoulder 40, alternatively formed as two mutually opposite supporting shoulders, which in the securing position, blocking the displacement of the locking slide 19, are located in front of a blocking shoulder or shoulders 41 of the housing 11. The blocking shoulders 41 are formed by integral protrusions of the longitudinal housing walls, 15, 16.

Figure 3:
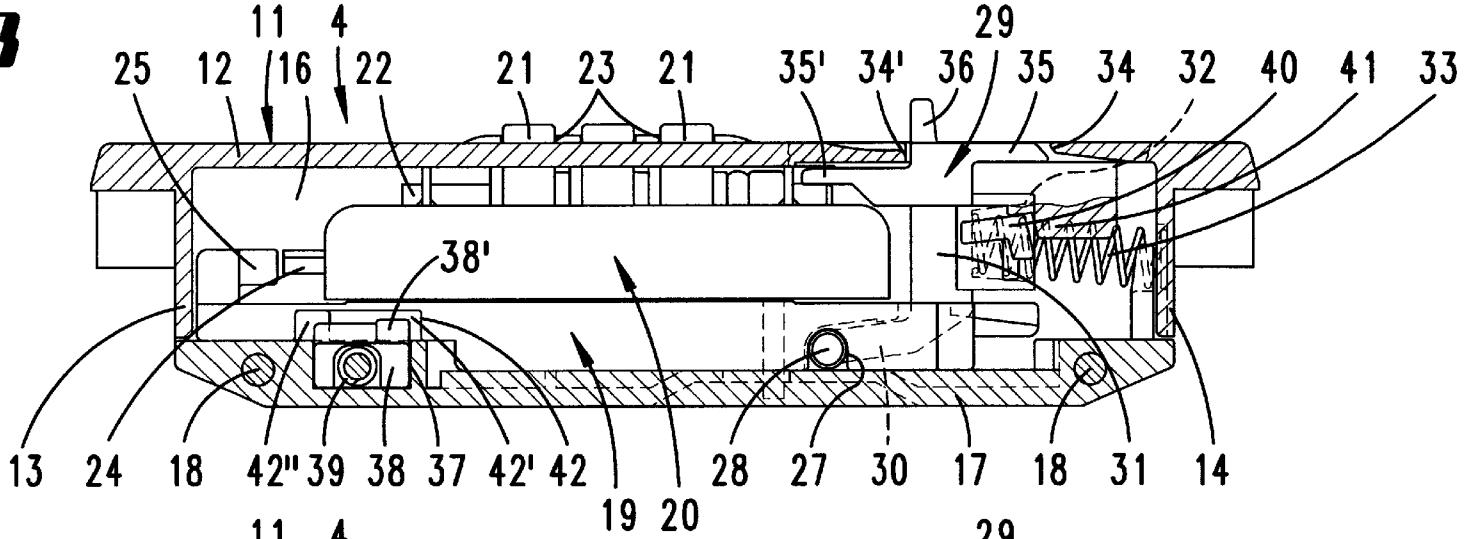
FIG. 3 shows the section along the line III—III, to be precise with the locking slide blocked by the safety catch of the case lock.
Figure 7:
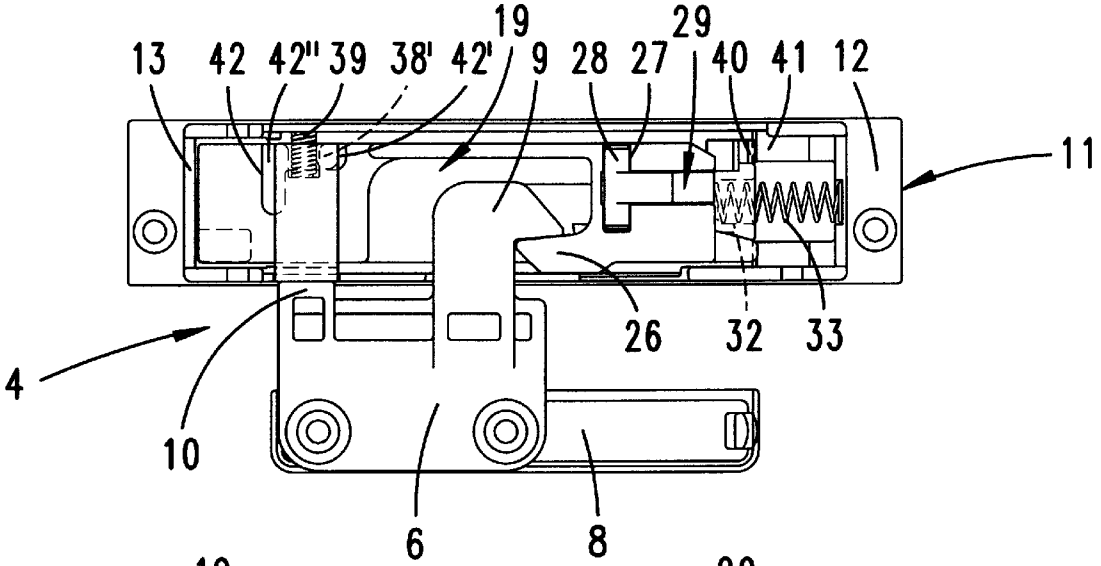
FIG. 7 shows a bottom view of the lock, with the lock base omitted, in the position according to FIG. 4.

Functioning is as follows:

FIGS. 3 and 7 illustrate the locked position of the case lock. This means that the case is closed. The locking slide 19 cannot be advanced into a release position by means of the grip 29 since the blocking rocker 24 is located in the displacement path of the stop protrusion 25.

Figure 4:
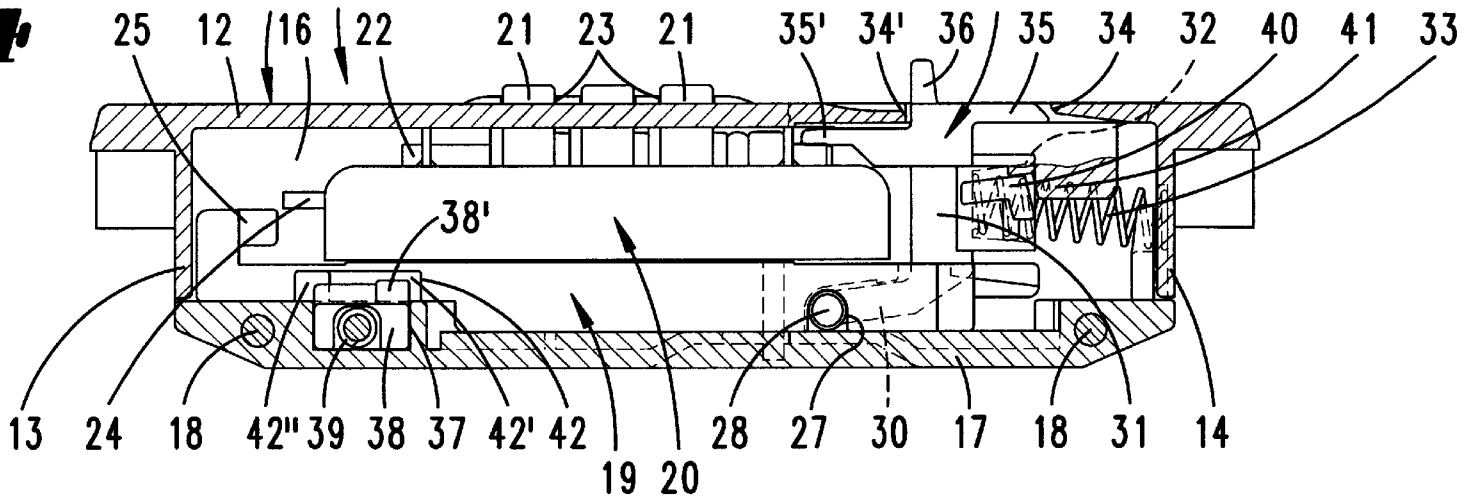
FIG. 4 shows an illustration corresponding to FIG. 3, although in this case the safety catch has passed into the release position in relation to the locking slide.
Figure 5:
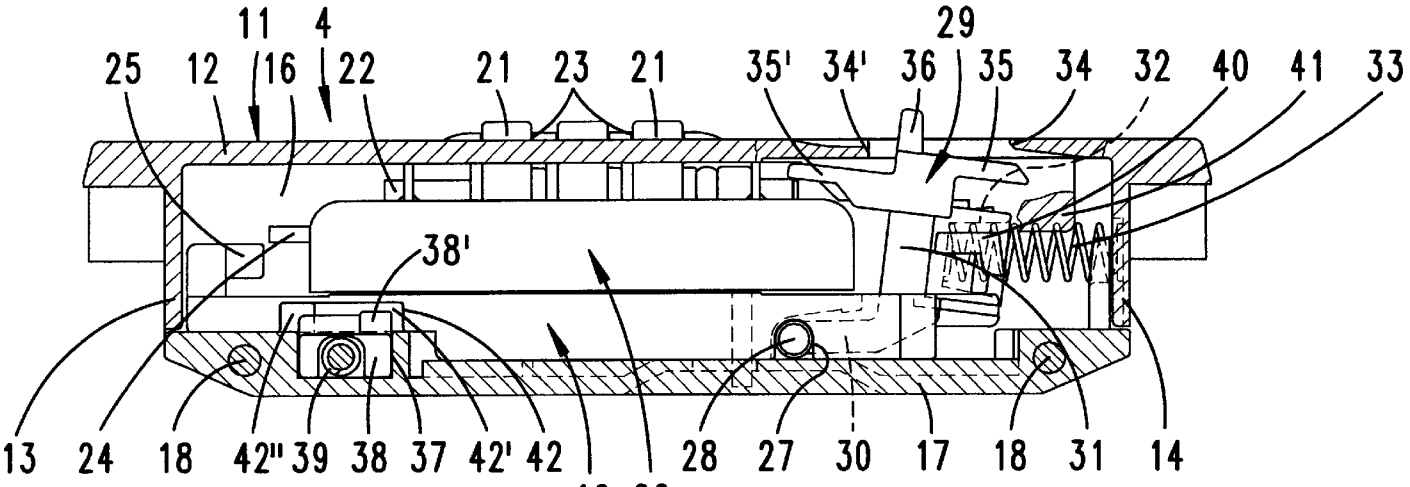
FIG. 5 shows the illustration following on from FIG. 4 with the grip pivoted.
Figure 6:
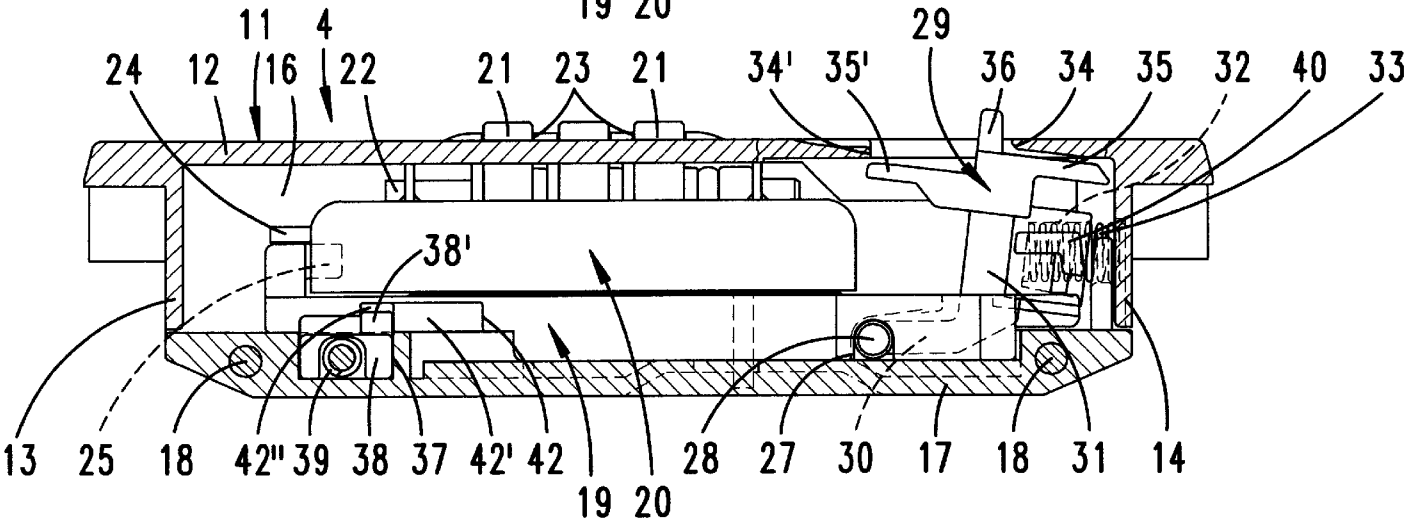
FIG. 6 shows an illustration like that in FIG. 5, the locking slide having been displaced in the release direction via the pivoted grip.
Figure 8:
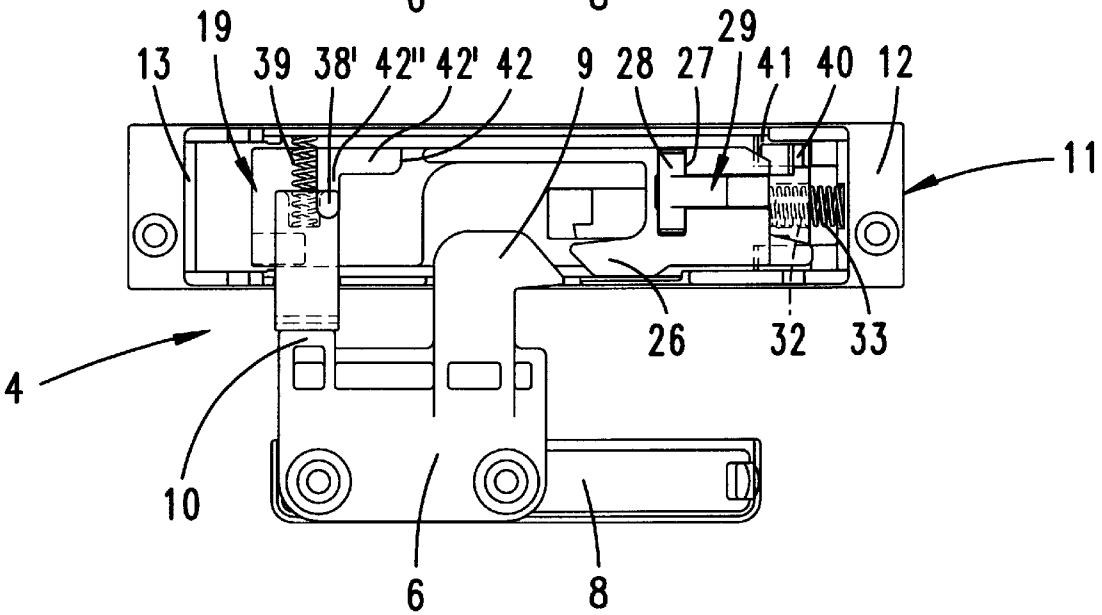
FIG. 8 shows an illustration which is comparable with FIG. 7, but with the locking slide displaced into the release position in accordance with FIG. 6.

The displacement of the locking slide 19 into its release position in relation to the mating closure part 6 first of all requires the secret code to be adjusted by means of the adjustment disks 21. Once this has taken place, the blocking rocker 24 pivots into the position according to FIG. 4. The grip 29 can then be forced in the slide-displacement direction by means of the finger-engagement web 36. This results in the grip 29 pivoting into the position according to FIG. 5, the supporting shoulders 40 being displaced out of their location opposite the blocking shoulders 41 of the housing 11. Continued activation of the grip 29 results in the locking slide 19 being carried along into the position according to FIG. 6. A guide protrusion 38' which is provided on the ejector 38, and is oriented in the direction of the locking slide 19, thus passes through an L-shaped guide groove 42 of the locking slide 19, to be precise the L-leg 42', which runs in the slide-displacement direction. In the end phase of the slide displacement, the guide protrusion 38' passes into the region of the other L-leg 42", which runs transversely to the slide-displacement direction. The compression spring 39, which subjects the ejector 38 to loading, can then come into action and activate the supporting protrusion 10 of the mating closure part 6. Since the hook protrusion 9 of the mating closure part 6 has been released, on account of the blocking web 26 being displaced as well, the ejector 38 can move the mating closure part 6 into the position according to FIG. 8, which then allows the lid part 3 of the case to be opened fully. In this release position, the locking slide 19 is blocked by the ejector 38 against being displaced back, because the guide protrusion 38' of the ejector 38 extends within the L-leg 42" of the guide groove 42, said L-leg extending transversely to the displacement direction of the locking slide 19, see FIG. 8. In this release position, the plate 35 of the grip 29 moves beneath the housing opening 34, as a result of which the grip 29 is prevented from pivoting back, see FIG. 6. However, the housing opening 34 is still covered, to be precise by a second plate 35', which is located opposite the plate 35.

In order for the locking slide 19 to be guided back, correct closure of the lid part 3 of the case is necessary. In the closing end phase, the supporting protrusion 10 activates the ejector 38 and displaces it to the extent where its guide protrusion 38' passes into the region of the L-leg 42'. The spring 33 can then come into action, said spring both pivoting the grip 29 back into its initial position and transferring the locking slide 19 into the securing position according to FIG. 4. If the case lock assumes this position, then no impact acting on the case 1 is capable of displacing the locking slide 19 into a release position in relation to the mating closure part 6. The blocking of the locking slide 19 can be brought about by the rotation of at least one adjustment disk 21, the blocking rocker 24 passing into the position according to FIG. 3. The hook protrusion 9, which has passed into the housing 11, is likewise blocked by the blocking web 26 of the locking slide 19, with the result that the case cannot be opened unless the predetermined secret code is adjusted and then the prescribed release position of the locking slide 19 is brought about.

I claim:

1. A case lock having a locking slide (19) which is arranged in a lock housing (11) and is intended for securing and, by grip-actuated displacement counter to spring force, for releasing a mating closure part (6), a grip (29) forms a supporting shoulder (40) which in a securing position, blocking the displacement of the locking slide (19), is located in front of a blocking shoulder (41) of the housing (11) and, by the grip (29) being pivoted transversely to displacement direction of the locking slide (19), is displaced into a release position releasing the support shoulder (40) from the blocking shoulder (41).

2. The case lock as claimed in claim 1, wherein the grip (29) is retained in the blocking position by a locking-slide spring (33) acting thereon.

3. The case lock as claimed in claim 1, wherein two supporting shoulders (40) are located approximately level with a spring-engagement point.

4. The case lock as claimed in claim 1, wherein an articulated connection between the grip (29) and the locking slide (19) is formed by a hook-in spindle (28) supported on a housing base (17).

5. The case lock as claimed in claim 1, wherein the locking slide (19) is retained in a release position by an ejector (38) which is displaced by spring force into an ejector position.

6. The case lock as claimed in claim 5, wherein by locking-slide displacement into the release position, the ejector (38) advances by spring action.

7. A case lock having a locking slide (19) which is arranged in a lock housing (11) and is intended for securing and, by grip-actuated displacement counter to spring force, for releasing a mating closure part (6), a grip (29) forms a supporting shoulder (40) which in a securing position, blocking the displacement of the locking slide (19), is located in front of a blocking shoulder (41) of the housing (11) and, by the grip (29) being pivoted transversely to displacement direction of the locking slide (19), is displaced into a release position wherein the locking slide (19) is retained in a release position by an ejector (38) which is displaced by spring force into an ejector position and, further comprising a guide protrusion (38') which engages in an L-shaped guide groove (42) of the locking slide (19) and belongs to the ejector (38), which is extendable transversely to the displacement direction of the locking slide (19).

8. The case lock as claimed in claim 1, wherein the locking slide (19) is blockable against displacement in a closed position by means of a safety catch (20).

9. The case lock as claimed in claim 1, wherein a plate (35) which closes off a housing opening (34) in the a closed position and belongs to the grip (29) moves beneath a housing wall following the pivoting of said grip during opening displacement.

10. The case lock as claimed in claim 1, further comprising a finger-engagement web (36) formed by the grip (29), the grip (29) being pivoted by a force exerted on said finger-engagement web in the slide-displacement direction.

* * * * *